US009670632B2

(12) United States Patent
Behan et al.

(10) Patent No.: US 9,670,632 B2
(45) Date of Patent: Jun. 6, 2017

(54) SHOVEL ASSEMBLY AND METHOD OF ASSEMBLY THEREOF

(71) Applicants: Richard Anthony Behan, West Chicago, IL (US); Paulette Sanders Behan, West Chicago, IL (US)

(72) Inventors: Richard Anthony Behan, West Chicago, IL (US); Paulette Sanders Behan, West Chicago, IL (US)

(73) Assignee: NORDIC AUTO PLOW LLC, West Chicago, IL (US)

( * ) Notice: Subject to any disclaimer, the term of this patent is extended or adjusted under 35 U.S.C. 154(b) by 0 days.

(21) Appl. No.: 14/680,342

(22) Filed: Apr. 7, 2015

(65) Prior Publication Data

US 2015/0284929 A1 Oct. 8, 2015

Related U.S. Application Data

(60) Provisional application No. 61/977,080, filed on Apr. 8, 2014.

(51) Int. Cl.
*E01H 5/06* (2006.01)
*E01H 5/02* (2006.01)

(52) U.S. Cl.
CPC ..... *E01H 5/061* (2013.01); *E01H 5/02* (2013.01); *Y10T 16/44* (2015.01); *Y10T 29/49947* (2015.01); *Y10T 403/32606* (2015.01)

(58) Field of Classification Search
CPC .. A01B 1/02; E01H 5/061; E01H 5/02; Y10T 403/32606; Y10T 29/49947; Y10T 16/44
See application file for complete search history.

(56) References Cited

U.S. PATENT DOCUMENTS 1,196,206 A * 8/1916 Bulger ..... E01H 5/02 294/53.5
1,375,505 A * 4/1921 Grady ..... E01H 5/02 37/284
1,524,639 A * 1/1925 Grady ..... E01H 5/02 37/284

(Continued)

FOREIGN PATENT DOCUMENTS

DE 102006043650 A1 3/2008

OTHER PUBLICATIONS

Kingstar Tools Co., Ltd; Snow Shovel on Wheels; Retrieved on Mar. 6, 2015: http://www.alibaba.com/product-detail/snow-shovel-on-wheels_60136409907.html.

(Continued)

*Primary Examiner* — Robert Pezzuto
*Assistant Examiner* — Adam Behrens
(74) *Attorney, Agent, or Firm* — Vedder Price P.C.

(57) ABSTRACT

A shovel assembly for use in association with snow, sand, or any other particulate matter for collection and cleaning residing on a flat horizontal surface such as the ground, more specifically the shovel assembly and a method of assembly and use thereof in which the shovel's blade is made of multiple interlocked sections, each having opposite top and bottom edges with different geometries adapted for different purposes, an adjustable composite handle with multiple grips for adaptation to varied user preferences and a dynamic pivot at the base of the handle to easily change the blade's push angle during use.

2 Claims, 10 Drawing Sheets

(56) References Cited

U.S. PATENT DOCUMENTS 1,956,295 A * 4/1934 Lindgren ..... E01H 5/02 37/284
2,432,780 A * 12/1947 Mader ..... E01H 5/02 16/235
2,967,363 A * 1/1961 Meier ..... E01H 5/02 294/53.5
4,878,704 A * 11/1989 Jacanin, Jr. ..... E01H 5/02 294/51
5,048,206 A * 9/1991 Jones ..... B62B 1/147 280/651
5,048,883 A * 9/1991 Waluk ..... E01H 5/02 294/54.5
5,228,734 A * 7/1993 Pollastro ..... E01H 5/02 294/51
5,440,828 A * 8/1995 Simpson ..... E01H 5/02 172/372
D373,292 S * 9/1996 Motley ..... D8/10
5,829,808 A * 11/1998 Colla ..... E01H 5/02 294/53.5
5,975,602 A * 11/1999 Zan ..... E01H 5/02 294/54.5
6,269,558 B1 8/2001 Alexander
6,435,580 B1 * 8/2002 Lock ..... E01H 5/02 294/54.5
7,237,814 B2 * 7/2007 Handzlik ..... E01H 5/02 294/51
7,305,779 B1 * 12/2007 Purvis ..... E01H 5/02 294/54.5
7,380,848 B2 * 6/2008 Petruzelli ..... E01H 5/02 294/53.5
7,743,536 B2 * 6/2010 Evans ..... E01H 5/06 172/273
7,810,259 B1 10/2010 Goldman
8,001,707 B2 * 8/2011 Coles ..... E01H 5/02 294/54.5
8,166,677 B1 * 5/2012 Woyak ..... E01H 5/02 294/54.5
8,800,175 B1 * 8/2014 Faraci ..... E01H 5/02 294/54.5
9,187,872 B1 * 11/2015 Hermanson ..... E01H 5/02
2001/0029685 A1 * 10/2001 Hendrick ..... E01H 5/02 37/270
2004/0060202 A1 * 4/2004 Petruzzelli ..... E01H 5/02 37/266
2004/0178646 A1 9/2004 Root et al.
2005/0012348 A1 * 1/2005 Handzlik ..... E01H 5/02 294/54.5
2006/0214443 A1 * 9/2006 Dixon ..... E01H 5/02 294/54.5
2006/0249964 A1 * 11/2006 Brazeau ..... E01H 5/02 294/54.5
2007/0108783 A1 * 5/2007 Petruzelli ..... E01H 5/02 294/53.5
2007/0187964 A1 * 8/2007 Marble ..... E01H 5/02 294/51
2008/0301980 A1 12/2008 Hill, III
2008/0309105 A1 12/2008 Hayner
2009/0235559 A1 * 9/2009 Coles ..... E01H 5/02 37/270
2010/0109358 A1 * 5/2010 Burke ..... E01H 5/02 294/58
2011/0001326 A1 1/2011 Towles
2012/0047777 A1 3/2012 Andreas
2013/0167413 A1 7/2013 Lewis

OTHER PUBLICATIONS

PlowSite.com; Western Plows Discussion; Retrieved on Mar. 6, 2015: http://www.plowsite.com/showthread.php?t=131955https://www.facebook.com/media/set/?...7587306&type=1.
Timberland Supply Co.; Power Equipment; Retrieved on Mar. 6, 2015:http://www.timberland-supply.com/BCSAttachments.html.
Qingdao Kaiweisi; Hand Operated Snow Plow, Manual Steel Snow Shovel With Wheels; Retrieved on Mar. 6, 2015; http://www.alibaba.com/product-detail/hand-operated-snow-plow-manual-steel_60086711244.html.

* cited by examiner

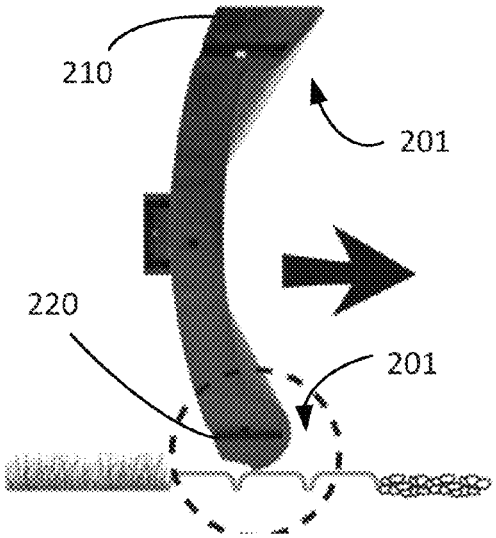
FIG. 6A
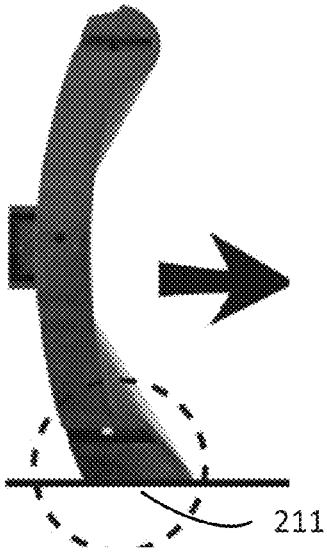
FIG. 6B
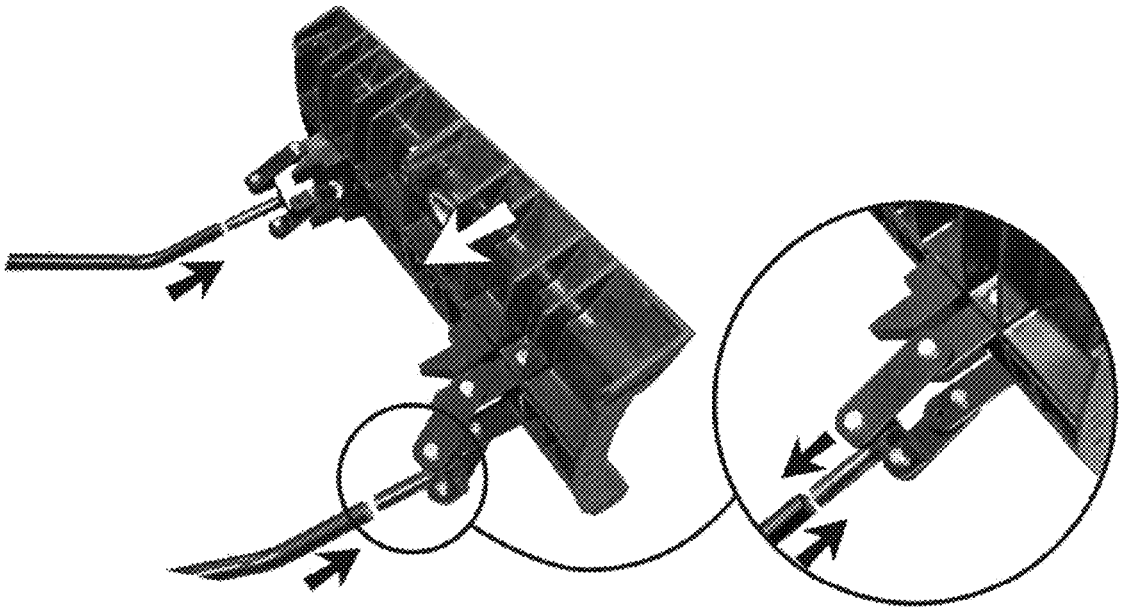
FIG. 7A
FIG. 7B

SHOVEL ASSEMBLY AND METHOD OF ASSEMBLY THEREOF

RELATED APPLICATIONS

The present utility patent application claims priority from and the benefit of U.S. Provisional Patent Application No. 61/977,080, filed Apr. 8, 2014, the contents of which are hereby incorporated by reference in their entirety.

FIELD OF THE INVENTION

The present disclosure relates to a shovel assembly for use in association with snow, sand, or any other particulate matter for collection and cleaning residing on a flat horizontal surface such as the ground, more specifically the shovel assembly and a method of assembly and use thereof in which the shovel's blade is made of multiple interlocked sections, each having opposite top and bottom edges with different geometries adapted for different purposes, an adjustable composite handle with multiple grips for adaptation to varied user preferences and a dynamic pivot at the base of the handle to easily change the blade's push angle during use.

BACKGROUND OF THE INVENTION

For anyone who lives in an area where snow storms, sand storms, falling leaves, or pebbles can accumulate, for example on a beach front after a hurricane, or in snowy areas, there is need for a way to remove quickly and efficiently the accumulated debris. Two technologies exist, either the vacuuming and accumulation system of the debris or a shovel (i.e. push) to help push the debris into accumulation zones. The following invention relates generally to a tool for the manual removal of debris and not the automated vacuum-based family of tools. As part of the current description of this new invention, the description is often related to the most common needs, the snow removal aspect and the use of the word shovel. In fact, what is contemplated as part of this disclosure is technology that can be used and adapted to any type of debris on a flat and mostly horizontal surface removed by manual labor or using any type of vehicle or tool.

To better understand the novel features of this new shovel assembly, we must first understand that several important constraints are unique to this field of technology. First, shovels are generally bulky and requires hand coordination and are therefore sold at home product retail surfaces where potential users can test in limited working conditions the products. The shipment by mail of these products remains today impracticable. Because of limited floor space of the retail giants who stock these products, they often prefer to offer a limited number of products which can be adapted, each to service a wider number of customers. Therefore, in this industry, there is a deeply-rooted need for products capable of adaptation even if any given user might only require a new shovel at one configuration. Retailers, faced with floor space restrictions, also try and stock the smallest and lightest products.

In addition to having to meet the needs of distributors and retailers, the same shovels must satisfy the unique needs of users and purchasers which varies greatly. Some need shovels to clear their long driveways, others live in a busy street corner, some have unique features on their landscape which require specific attention. Each of these users also has a different storage capacity, for example many real-estate renters will only have limited garage area. Some other owners might need to shovel around a motorhome parked in a lot and the shovel assembly would need to be stored in bins below the motorhome. Some other shovels are purchased by energetic students with the entrepreneur virus to clear the driveways of multiple street neighbors; these devices must be sturdier than ordinary.

Because of this wide range of needs, a valuable shovel will suit the greater number of customers, and consequently a lower number of shovels will have to be stocked by a retailer to satisfy all of the needs of its customer base. In a perfect world, a shovel would have no weight yet have inertia to push shown. It would be sturdy enough not to break or get damaged under normal and exceptional use, yet be easily collapsible. The perfect shovel would be adapted for long period of storage and temporary storage between two successive snowstorms and of course its manufacturing price would be very low. Finally, the perfect shovel could easily be adapted for the user's own height and strength. Therefore, novel features are important in this art, but their combination on a single shovel are also key to a better product. The current invention describes a shovel assembly which as a whole, greatly improves on existing technology and meets the needs of many more customers and retail managers.

Shovels all include a front blade, curved in one way or another with a bottom edge. Under gravity, the blade scrapes on the ground as the shovel is pushed forward to collect the snow. This blade is attached to some type of handle which can be held and pushed by the user using his or her hands or sometimes a bar is provided to push using the center of gravity. The handle is attached behind the blade in a way which allows easy control over the movement of the shovel blade. In most models, the blade is a thin and curved piece of stainless steel or aluminum. Rivets or bolts are punched into the metal blade to attach a single wooden handle or a U-shape bar. On each handle is placed a plastic hand-sized grip or a polymer handle. In some other models, a vertical hinge between the back of the blade and the handle allows a user to flip the blade and use both sides of the blade once one is damaged.

Shovel blades can be made of multiple segments. U.S. Pat. No. 5,228,734, teaches how lateral extender pieces, formed with curved segments with lateral support and holes can be added to a central piece using bulky and heavy pins. This reference teaches the creation of a single wide blade, with one handle and up to five segments. The effective portion of the blade in contact with the snow is filled with ribs, pins, and other heavy elements making the use of this product impracticable at best. In addition, because of assembly tolerance, the blade once assembled is not whole or strong. A decade after this first technology was disclosed, U.S. Pat. No. 7,237,814, showed how two small shovels can be paired at their internal junction and how a connecting piece can unite the two handles of the united shovels. Several latching mechanism are shown, they include a straight C-shape connector, a series of tab openings, and walls and knobs. In each configuration the shovel remains heavy, impracticable to use, and the snow cleaning area is filled with ribs, ridges, and walls. What is needed is a shovel assembly designed to operate relatively in the same way a single shovel when extended to a wider removal area.

Next, shovels are often used over multiple different surfaces to push different types of products. The edge upon which the shovel resides is an important element of the shovel. If only an inch of light snow has fallen on a flat newly-paved driveway, a flat angled edge might be prefer-able to quickly move snow. If the same snow has fallen on grass, what may be desired is a different type of edge capable of movement without damaging the surface or the edge. A person could, for example, use a shovel to remove heavy snow from a roof. Since frozen roofing material is often vulnerable puncture and rips, a shovel must be able to be used in such a condition (using other safety equipment) to protect the roof while pushing the heavy snow.

U.S. patent application Ser. No. 10/387,214, published as U.S. Patent Publication No. 2004/0178646, teaches how a flat metal blade can be bent in a C-shape and where both the top end and the bottom end can be used alternatively. A top edge has a rounded tip and the other has the normal end of a flat and bent sheet of metal. The use of a rounded edge as described is used at the end of a horizontal segment which slides on the ground to capture within the C-shape the content for removal. What is needed is a assembly which offers greater versatility and flexibility of options to users of shovels over this existing technology.

A third key feature is the way shovels are held and handled during snow removal. Over the centuries, multiple new tools have been invented to help users with the manipulation of different shovels. Different types of handles, guides, and other attachments help this technology improve slowly over time. The proper handling of a shovel, much like any other hand held equipment, is very complicated. The blade must be balanced or it will damage a wrist. The tool must be able to be lifted from the ground and shook to remove snow. The blade must be designed in a way which allows swift movement and evacuation or collection of the debris located in the blade.

To name a few, U.S. Pat. No. 8,166,677 teaches how shoulder pads can be mounted on a handle to help transfer momentum from a user to the blade. While this technology appears at a glance to be useful, in fact each time a rock or difficult edge is encountered by the blade, the force is driven directly into the spine of the user. The use of hands on a blade allows for the cushioning of any back force resulting from uneven ground conditions. U.S. Pat. No. 5,048,883 teaches another version of a possible handle which incorporates four different handles, two in lower position and two in upper orientation. This type of technology is designed to give a user an option as to which hand is better suited for the use. For example, if the snow is light and fluffy, the user can extend his or her arms and push with an angle closer to his or her center of gravity. If the snow is heavier, the same user can bend the arms and rely on his or her center of gravity to push.

One other important feature of snow blades is the mechanism used to attach a handle to the blade. What is needed is the capacity to tilt or change the orientation of the blade while at the same time giving enough strength to the shovel so it can be lifted and manipulated without the blade falling down. U.S. application Ser. No. 12/459,607, published as U.S. Publication No. 2011/000132 teaches how a three axis pins and pistons system can be used to quickly adapt and fix the blade orientation compared to the handle in any position. Such a system is heavy, complex, and costly. U.S. Pat. No. 6,435,580 shows how a pivot can be incorporated into the blade. This pivot will over time be damaged, may jamb with snow, and more importantly does not allow for the blade to be rigid in any given orientation. As the user lifts the blade to remove snow stuck to it, the blade can tilt down to hurt a leg. What is needed is a improved system which is cheap, easy to manipulate and durable.

What is needed is a single shovel assembly, having improved blade, handle, connection, and symmetry features which result in a new a multiple new way and methods to shovel snow, or store the shovel. While each improved features, by themselves, is an improvement over the art, their combination as part of a single shovel results in a very useful product.

BRIEF SUMMARY OF THE INVENTION

The present disclosure relates to a shovel assembly for use in association with snow, sand, or any other particulate matter for collection and cleaning residing on a flat horizontal surface such as the ground, more specifically the shovel assembly and a method of assembly and use thereof in which the shovel's blade is made of multiple interlocked sections, each having opposite top and bottom edges with different geometries adapted for different purposes, an adjustable composite handle with multiple grips for adaptation to varied user preferences and a dynamic pivot at the base of the handle to easily change the blade's push angle during use.

The shovel assembly includes two or more polymer-based interlocking segments to form a single flat blade. The blade is also made to tilt at an angle to help the snow flow sideways, the tilt is made using a dynamic connector at the base of the handle. With a twist of the wrist, a user having customized the dynamic connector can change the tilt angle from a positive left angle to a negative right angle.

BRIEF DESCRIPTION OF THE DRAWINGS

FIG. 6A is an illustration of a side view of the blade segment shown at FIG. 4 over an uneven surface to illustrate how the rounded bottom edge moves over ground according to an embodiment of the present disclosure.

FIG. 6B is an illustration of a side view of the blade segment shown at FIG. 4 over an even surface to illustrate how the sharp edge can move over a flat surface according to an embodiment of the present disclosure.

FIG. 7A is an isometric illustration of the shovel assembly connection area according to an embodiment of the present disclosure.

FIG. 7B is a close up view of the connection area between the blade area and the handle area as part of the shovel assembly shown at FIG. 1.

DETAILED DESCRIPTION OF THE INVENTION

Figure 1:
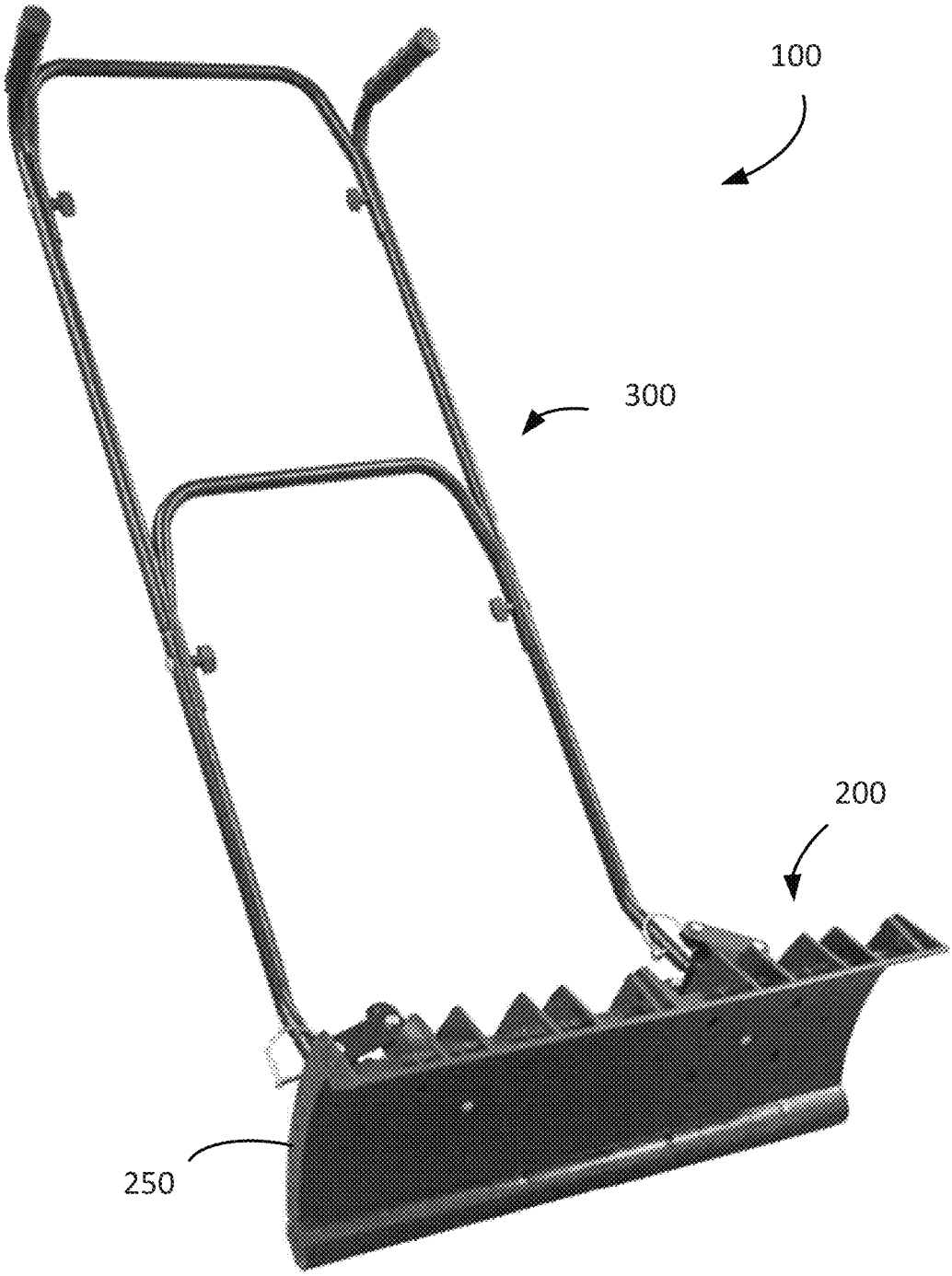
FIG. 1 is an isometric view of the shovel assembly according to one embodiment of the present disclosure.

FIG. 1 is a perspective view the shovel assembly 100 assembled in one possible configuration and ready to use by a user. To help describe this shovel assembly, the shovel assembly 100 includes a blade area 200 and a handle area 300 attached to the back of the blade area 200 by a connector to form the shovel assembly 100. While FIG. 1 shows one possible embodiment as part of the blade area 200, and also shows one assembled handle as part of the handle area 300, one must understand that novel features described which are relevant to either of these areas can, when possible be implemented in a different shovel assembly 100 with a different blade area 200 or a different handle area 300.

Figure 2:
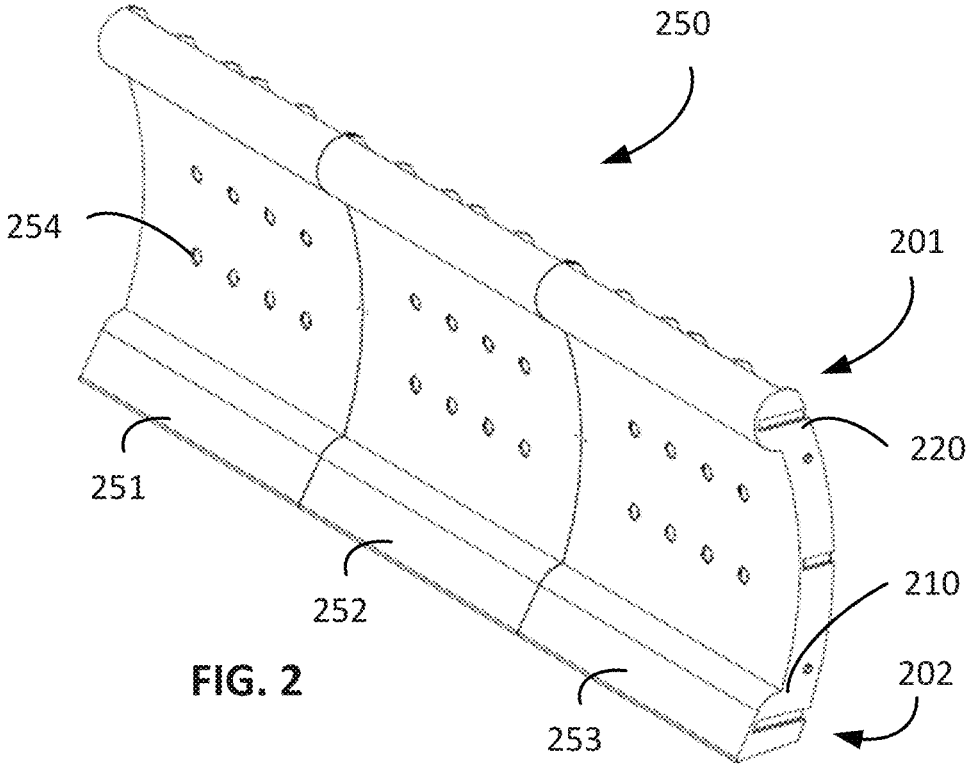
FIG. 2 is an isometric frontal view of a three segment blade assembly for use in association with the shovel assembly as shown with two segments at FIG. 1.

As will be explained in greater detail below, the current disclosures describes a shovel assembly 100 where the blade area 200 includes a multi-segment blade 250 shown at FIG. 2. This blade 250 includes a top edge 201 and a bottom edge 202 where one of the edges 201, 202 is to be rested against a horizontal surface (not shown) during use. In the configuration as shown at FIG. 1, the top edge is a sharp edge 210 and the bottom edge 202 is a rounded edge 220. FIG. 2 shows these edges 210, 220 reversed. Since both edges 201, 202 can be made to rest against the horizontal surface simply by flipping the handle 180 degrees, the top edge can be made to rest on the bottom and vice-versa. One of ordinary skill in the art will understand that the use of the words top and bottom as part of this discovery is only descriptive of a single embodiment and should not be used to limit the description of the current invention to the bottom always being closer to Earth than the top.

FIG. 1 also shows a configuration where the two grips or handles 301 are pointing upwards. Again, since multiple configurations of assembly of the handle area 300 are contemplated, the embodiment shown is only illustrative and not to be construed as the preferred embodiment. Also, FIG. 1 illustrates a blade with two segments, while FIGS. 2, and 3 shows the same blade 250 with three segments the current invention contemplates the use of any number of segments to form the blade as shown at FIG. 2.

FIG. 2 is a front isometric view of the multi-segment blade 250 with three multi-blade segments 251, 252, and 253 in the assembled configuration. Several rows of holes are shown 254 which for example could be a design element but in a preferred embodiment are simply functional opening to allow for the fixation of different connectors, in this case the different pieces of the dynamic connector described below and attached to the back of the blade 250 by sliding bolts or other attachment means to the segment 251, 252, or 253. These segments 251, 252, and/or 253 (or more) are attached using small connectors, such as bolts and screws on the different ribs on the back of the blade 250.

Figure 3:
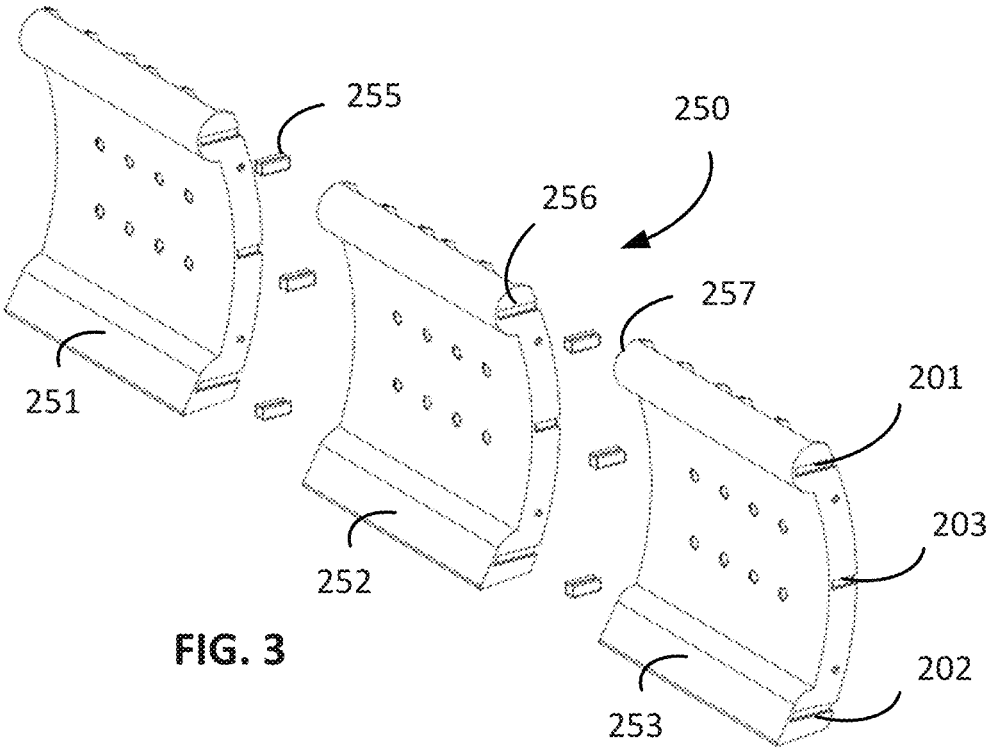
FIG. 3 is an exploded isometric frontal view of the three segment blade assembly shown at FIG. 2.

FIG. 3 illustrates the multi-segment blade 250 shown at FIG. 2 with three segments 251, 252, and 253 in an exploded configuration. Connectors 255 (here illustrated using a set of three sliding wedges) described as a first connector 255 can be used to attach as a connecting means the side 256 of a first segment 251, 252, or 253 with the side 257 of a second multi-blade segment 251, 252, or 253. As shown at FIG. 3, in one embodiment, connectors 255 are three sliding wedges arranged to connect at the top edge 201, the bottom edge 202, and a middle portion 203. What is not shown but is contemplated is the use of side covers which slide upon or are mounted to any visible side edge 256, 257 to help improve the aesthetics of the blade assembly 100.

Figure 4:
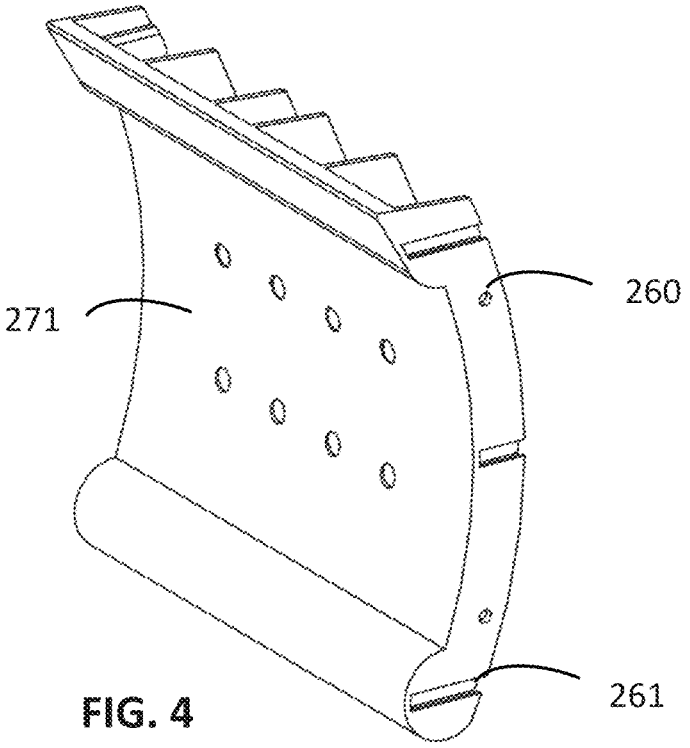
FIG. 4 is an isometric view of the flat front surface of one of the blade segments for assembly as part of the shovel assembly shown at FIG. 1.
Figure 5:
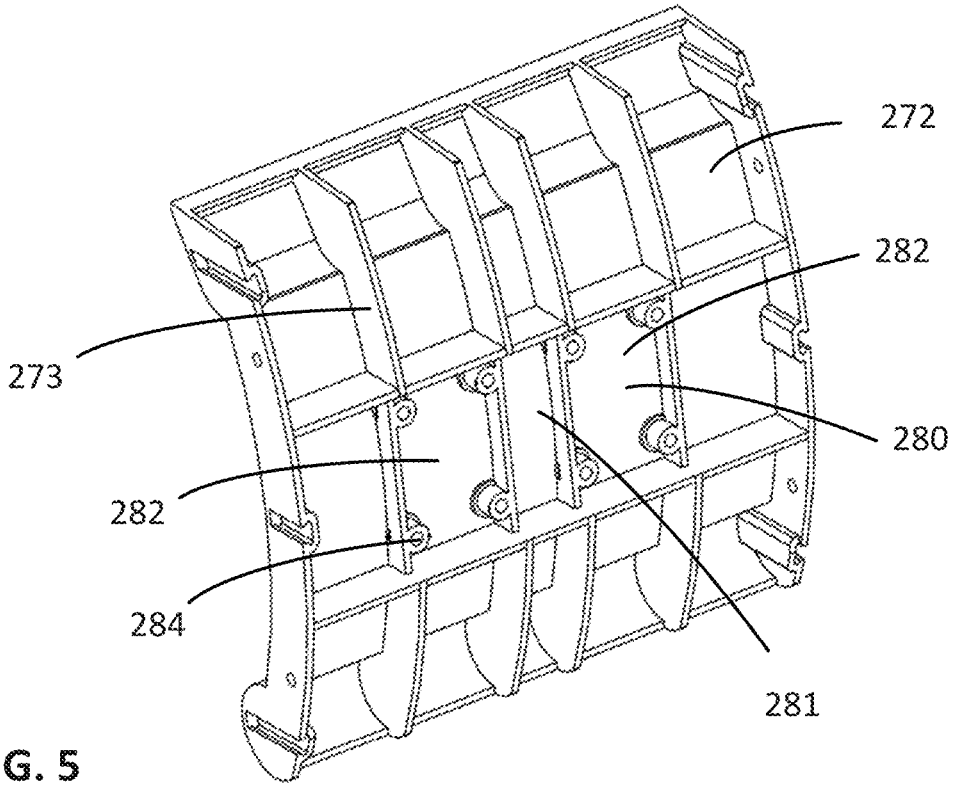
FIG. 5 is an isometric view of the back surface of the blade segment shown at FIG. 4, according to an embodiment of the present disclosure.

FIG. 4 is an isometric view of one of the three segments 251, 252, 253 shown at FIG. 3, and one of the two segments of the blade 250 shown at FIG. 1, providing with greater details as to the interface of the connecting means 255. In this case, holes can be punched 260 to use bolts or other ties and slits 261 can be used which do not perforate all the way to the front blade. FIG. 5 shows a view of the back of the segment shown at FIG. 5.

FIGS. 6A and 6B illustrate a side view of how the top edge 201, and the bottom edge 202 on any given segment 251, 252, and 253 can be either rounded 220 or a sharp edge 210. The large arrow indicates the direction of movement and the ground is illustrated with some bumps to help understand some of the advantages of the rounded edge 220 at it moves over the ground. The sharp edge as shown includes a flat area 211 next to the sharp edge 210. While the configuration is shown where the top edge 201 and the bottom edge 202 have two different configurations (rounded and sharp), one of ordinary skill in the art will understand that segments 251, 252, and 253 could be provided with the top edge 201 and the bottom edge 202 having the same configuration or having a different configuration.

While FIG. 4 shows the flat front surface 271 on the body 251 made of non-metallic material used to push debris, for example molded polymer. In contrast, FIG. 5 shows the back surface 272 which is reinforced with ribs 273 and openings for bolts and helps see what is described as a first location 280. As shown with greater detail in next figures, in one embodiment the ribs 273 help define niches for what is described as a first location 280, or a second location 281. In this case, what is shown are a right mounting location 282, and a left mounting location 283 on either sides of the second location 281. The different elements forming a dynamic connector as explained with greater detail at FIGS. 7A, 7B, 9, and 10. In each of the three locations 281, 282, and 283, multiple different systems can be contemplated to secure plates or other elements forming a dynamic connector to the back surface 272. As shown, four holes 284 for bolts can be used.

Figure 8A:
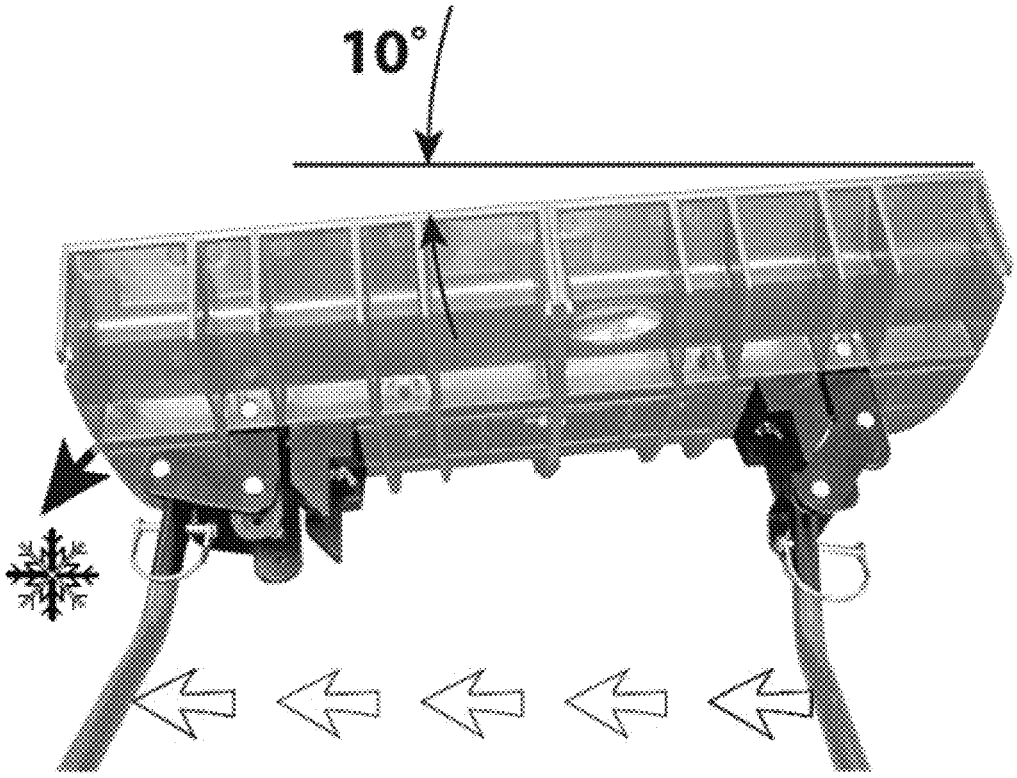
FIGS. 8A and 8B are two dynamic views illustrating how the dynamic connector works and results in a tilt of the shovel blade either to the left or to the right according to an embodiment of the present disclosure.
Figure 8B:
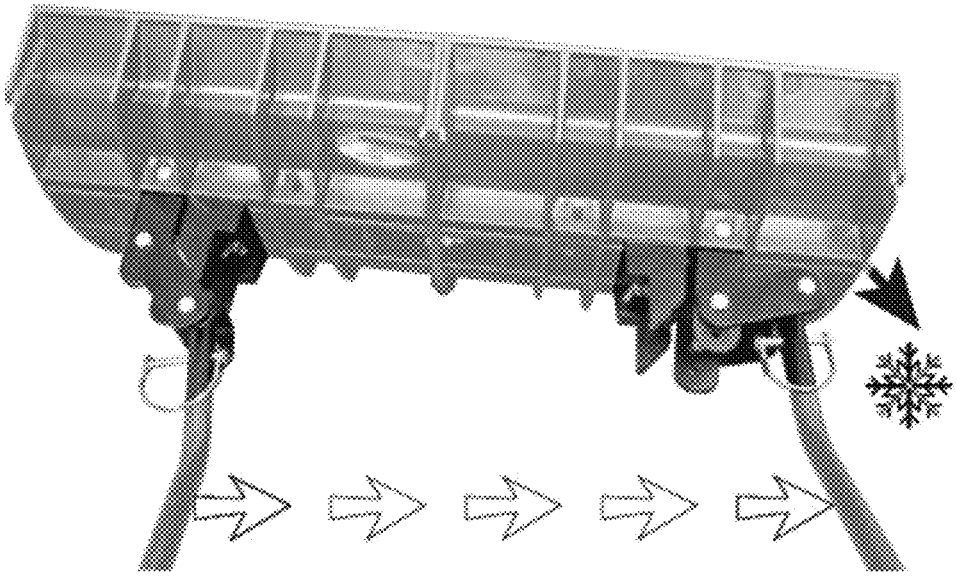

FIG. 7A and close-up FIG. 7B help provide a first illustration of the dynamic connector 400 that can be used in the back of the blade. This dynamic connector 400 helps link and attach the handle area 300 to the blade area 200 of the shovel assembly 100. As is shown at FIG. 1, in this embodiment the multi-segment blade 250 has open sides which allow the snow as plowed to slide to the side. The objective is to offer a simple system which allows for the blade 250 with a twist of the wrist of the user at the handle area 300 to move the blade area 200 to a tilt angle. This angle (two contemplated angle of 5 deg. and 10 deg.) can be obtained either on the left as shown at FIG. 8A or on the right as shown at FIG. 8B. FIG. 8A illustrates the tilt angle of 10 degree and uses an arrow to show how the snow will slide as the user pushes the handle and the blade forward. While angles of 5 and 10 degrees are shown, what is contemplated is the use of any angle and configuration extrapolated from this described invention. As shown, a user only needs to pull back and slide sideways the handle to change reverse the front tilt angle of the blade 250.

Figure 9:
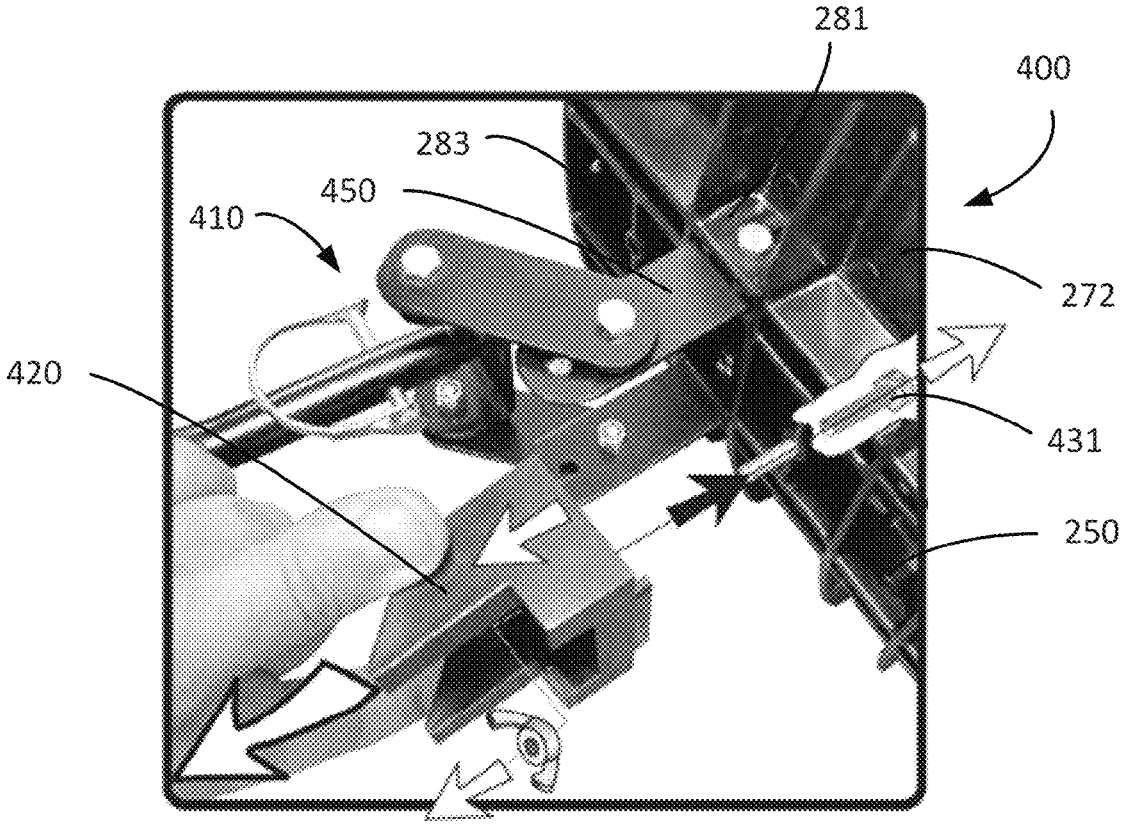
FIG. 9 is a detail isometric illustration of the dynamic connector as part of the shovel assembly according to an embodiment of the present disclosure.
Figure 10:
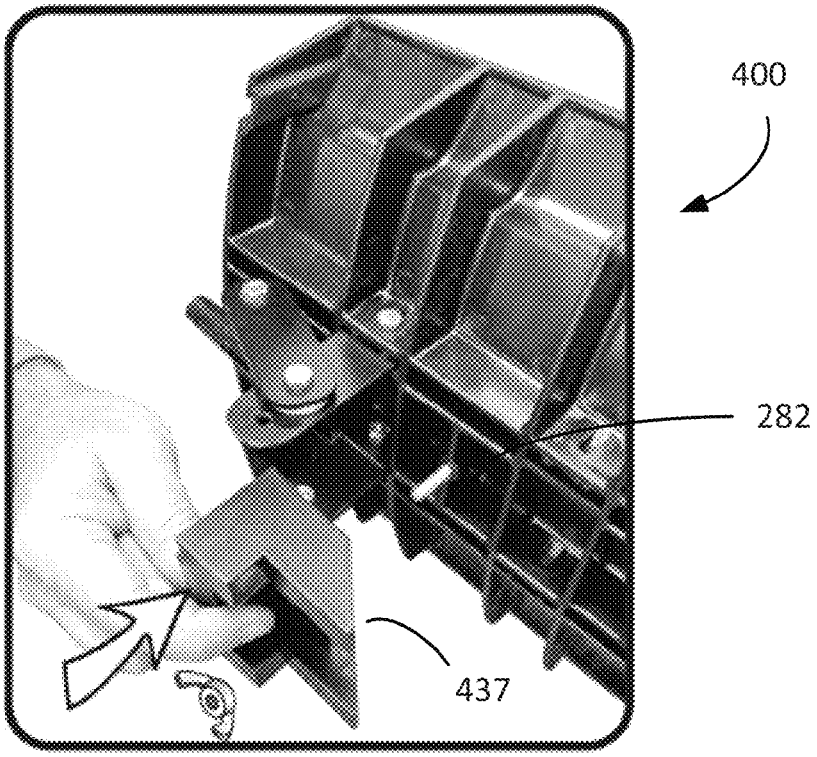
FIG. 10 is a detail isometric illustration of the dynamic connector illustrating how the block can be used in a second configuration as part of the shovel assembly according to an embodiment of the present disclosure.

FIGS. 9 and 10 show how the dynamic connector 400 is installed on the back of the blade 250. This connector as shown is made of three elements, a pivot connector 410 for sliding into the second location 281, a block 420 for sliding in the second location 281 either on the right mounting location 282, or the left mounting location 283. As shown at FIG. 7B, the block 420 is mounted on the left mounting location 283. At FIGS. 8A and 8B, the blocks 420 are mounted inside of the two second locations, on the left portion on the right mounting location 282 and on the right portion on the left mounting location 283.

FIGS. 9, and 10 help illustrate how a block 420 can be mounted in two different orientations which in turn will result in two different spaces (notch sizes) being created by the block 420 which in turns results in a different angle (FIG. 9 a total of 10 degree and FIG. 10 a total of 5 degree). As shown, a securing means like a bolt 431 can be used to secure the block 420 to the back of the blade 250.

Figure 11:
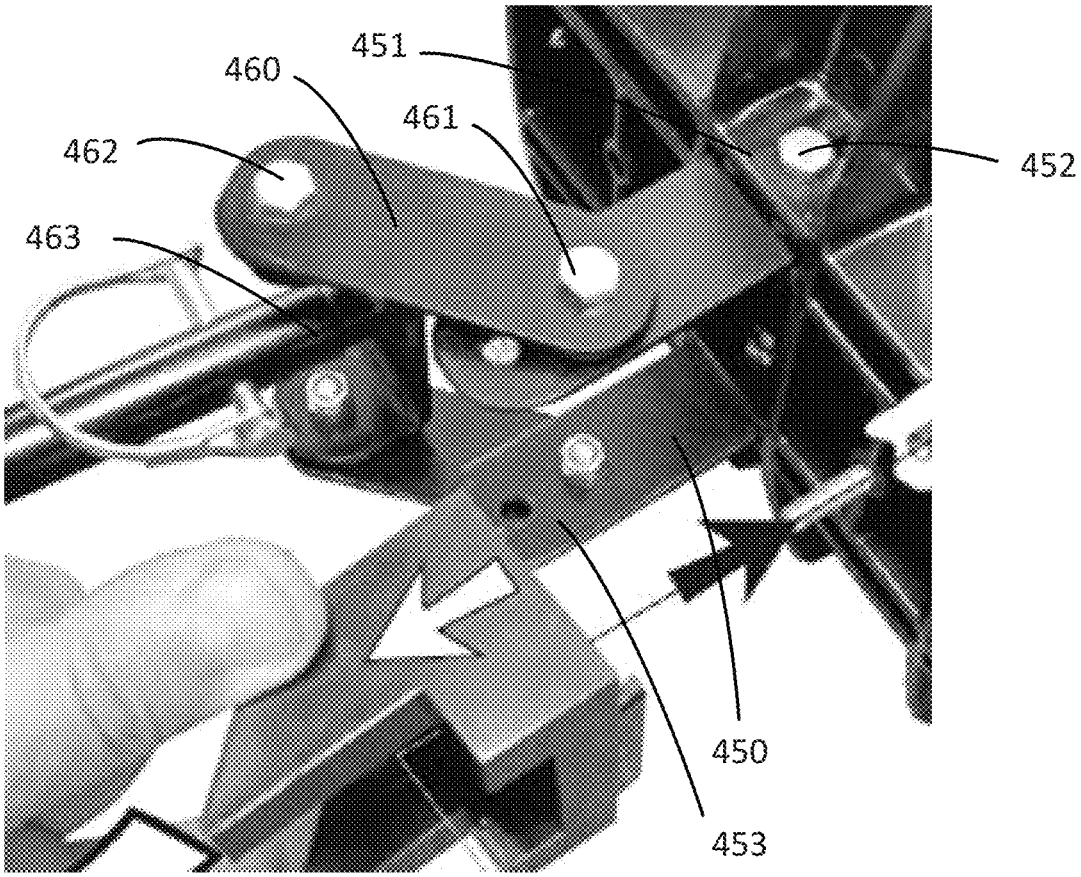
FIG. 11 is a close-up view of part of the sub-elements of the dynamic connector shown at FIG. 9.

As shown also with the help of the close-up of FIG. 11, from FIG. 9, the dynamic connector 400 built for a shovel assembly 100 is located between a pivotal end of shovel handle 410 and a second location 281 on the back surface 272 of shovel blade 250 located between a right mounting location 282 and a left mounting location 283 adjacent to the second location 281. The dynamic connector 400 includes as shown at least a first pair of parallel plates 450 each having a first end 451 for attachment to the back surface with for example a bolt 452. The bolt 452 at the second location 281 and the oblong U shape plate 450 includes a second end 453 in opposition thereof. While one type of fixation device 450 is shown, what is contemplated is the use of any system or attachment means which allows the same functionality. For example, a light plastic cube could be used.

The connector 400 also includes at least a second pair of parallel plates 460 or the equivalent structure where each plate includes a third end 461 for attachment and pivotal connection with the second end 453 of one of the plate of the first pair of parallel plates 450 using and a fourth end 462 in opposition thereof for pivotal connection to the pivotal end 463 of the shovel handle. Once again, what is shown in FIGS. 9, 10, and 11 is one possible configuration of the plates and elements forming the connector 400. One of ordinary skill in the art will understand that different means and equivalents allows to perform essentially the same function, using the same means, and securing the same result. For example, custom molded pieces can be made to replace most of these elements or merge these elements into sub-assemblies. What is contemplated and covered by the current disclosure is the use of these equivalents.

FIGS. 9, and 10 show at least a spacer block 420 with a base 421 for attachment to either a right mounting location 282 or a left mounting location 283 adjacent both called the first mounting location next to the second location 281 as explained above. In one embodiment, a single bloc 420 is L shape and can be mounted on two of its four sides at the right or left mounting location 282, 283. As shown, the block 420 has an internal opening to help mount the block 420 with its attachment. The block 420 creates a step notch 437 at a distance away from the back surface for resting the piece 410.

Different configurations of where (if at all) are one or two blocks 420 slid into the first location either at the right or left mounting location 282, 283 results in different configurations of use of the shovel assembly. In a related embodiment, the fourth end 462 includes several different holes to change the different length and distances of the dynamic connector 400. Also, many other pieces, supports, pivots, and connectors can be used to help modulate and change the different distances away from the back surface as a step notch 437 or any other configuration.

As described above, what is shown is a shovel assembly comprising at least two segments to form a multi-segment blade having a front surface to push debris, a back surface in opposition to the front surface with a dynamic connector, a top edge and a bottom edge for resting against a horizontal surface, and a modular handle for dynamic attachment to the dynamic connector, wherein the front surface is a flat surface, wherein at least one of the top edge or the bottom edge includes a rounded edge, wherein the modular handle includes a means of attachment of at least a pair of hand grips in either a top orientation or a bottom orientation, and wherein the dynamic connector allows for a sideways tilting of the blade in at least two different angles.

Figure 12:
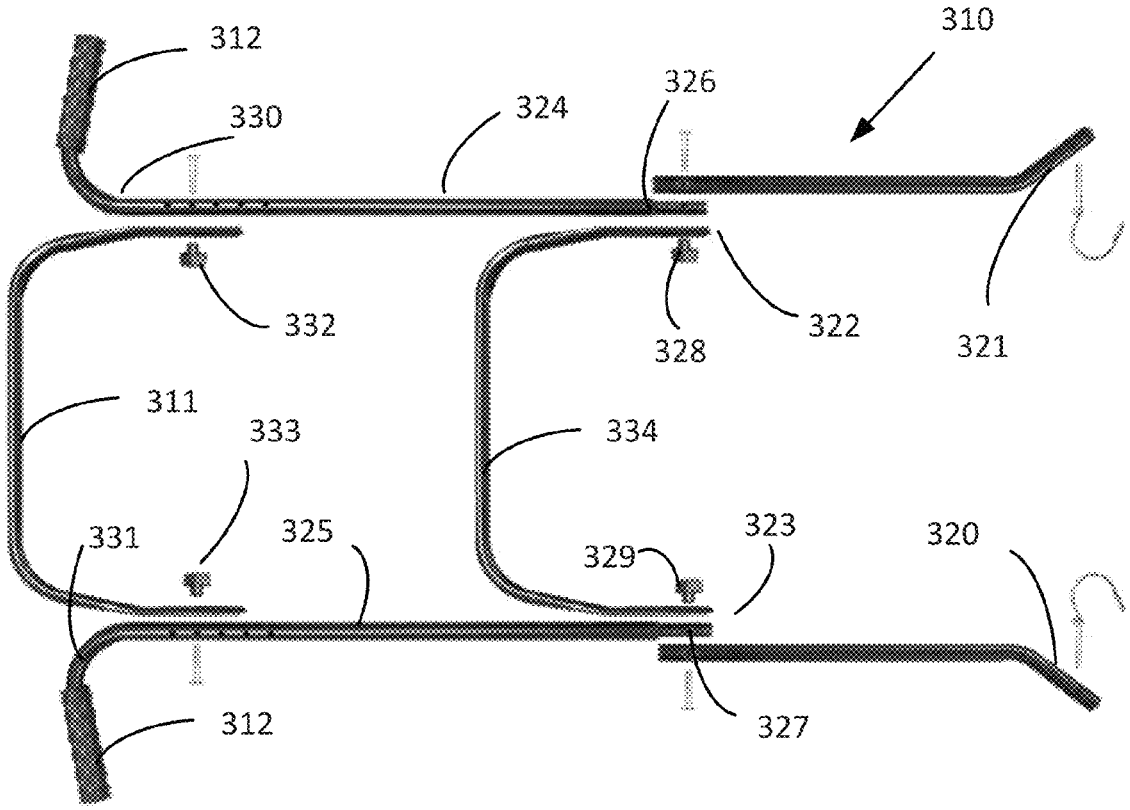
FIG. 12 is a top view of a disassembled handle from the handle area of the shovel assembly according to an embodiment of the present disclosure.
Figure 13:
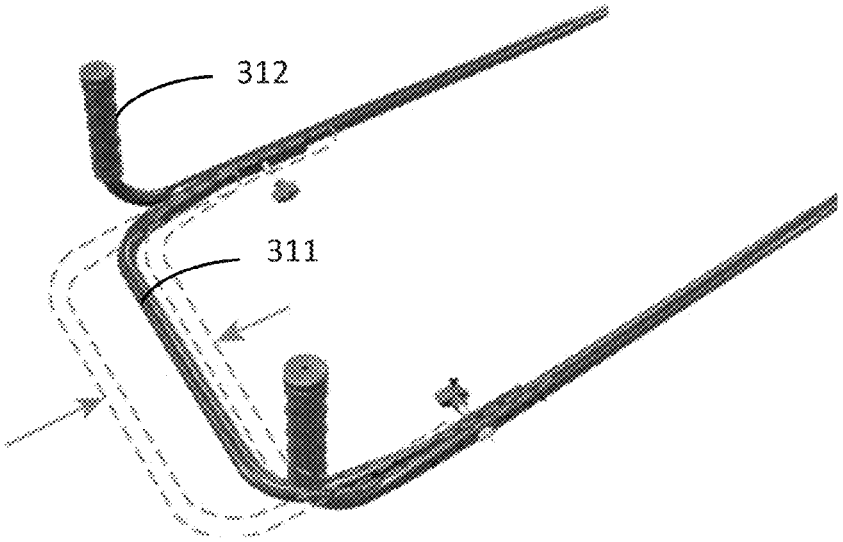
FIG. 13 is an illustration showing how the end push bar as part of the handle shown at FIG. 12 can be modulated according to an embodiment of the present disclosure.
Figure 14:
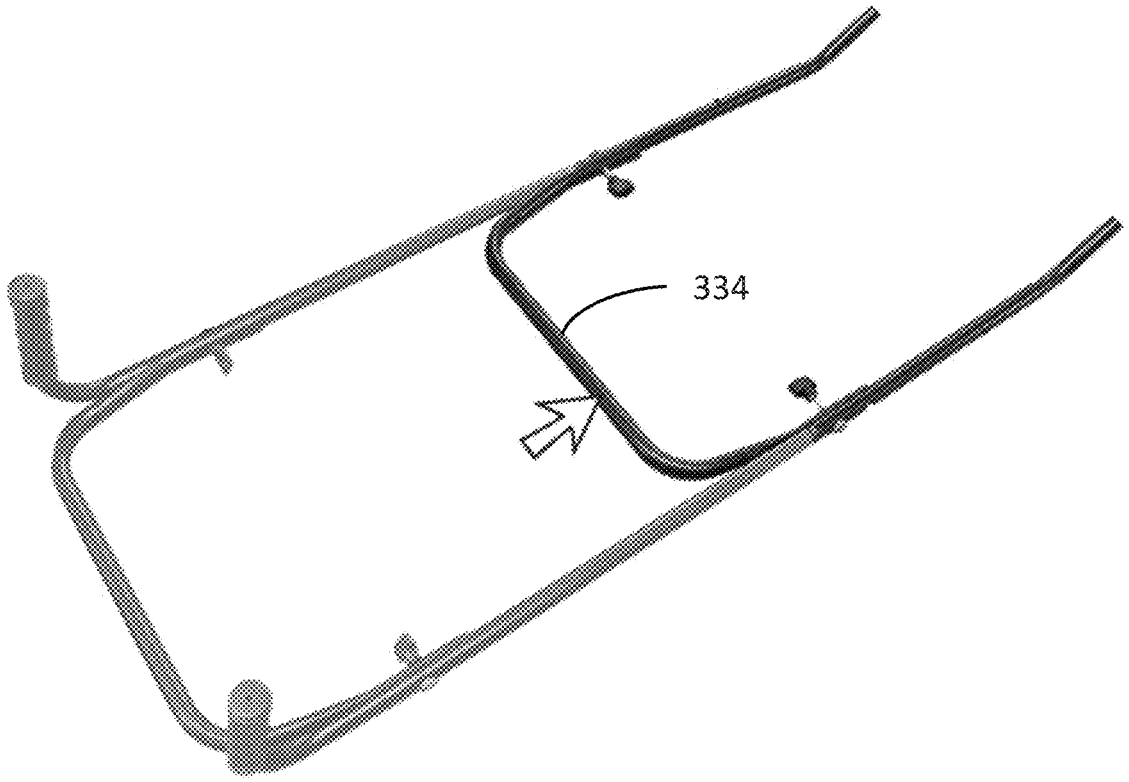
FIG. 14 is a second illustration showing how the intermediate push bar as part of the handle shown at FIG. 12 can be modulated according to another embodiment of the present disclosure.

FIGS. 12, 13, and 14 are different illustrations of the handle area 300 as shown at FIG. 1. The handle 310 includes to bars such as a lap bar 311 located between the pair of hand grips 312 shown in one orientation (upwards). The same hand grips 312 can be placed in any of a multiple number of orientation. The handle as shown can be a single long item or a U shape. The modular handle of FIG. 12 is U-shape and where both ends or tips 320, 321 connect with the dynamic connector as shown with greater detail at FIG. 9.

What is shown is a modular handle 310 for a shovel assembly 100 includes a first pair of connector tubes 325, 326 each having a first tip 321, 320 as shown at FIG. 12 for a pivotal connection to a dynamic connector 400 located on a back surface 272 of a blade 250 and a second tip in opposition 322, 323, a second pair of connector tubes 324, 325 each having a third tip 326, 327 for attachment via a first securing means 328, 329 to the second tip 322, 323 and a fourth tip 330, 331 in opposition with a grip 312.

The handle 310 can also include a first push 311 bar connected to the two fourth tips 330, 331 via a second securing means 332, 333, and a second push bar 334 connected to the second 322, 323 and third tips 326, 327 of the first and second pairs of connectors 328, 329, via the first securing means. One of ordinary skill in the art will understand that while one possible type of connector, handle, or tube is shown, what is contemplated is any equivalent or functional similar structure known in the art.

FIG. 13 shows the handles 312 attached in one possible configuration (upwards). The second pair of connector tubes 324, 325, include a series of symmetrical holes at the third tip 326, 327, and the fourth tip 330, 331 for connecting the connector tubes in two orientations at 180 degree lengthwise, and wherein the grips 312 are bent away from the lengthwise direction which allows grip to be attached at two opposite orientations as the connector tubes. FIG. 14 simply illustrates how the second push bar 334 can also be adapted using the securing means 328, 329.

Figure 15:
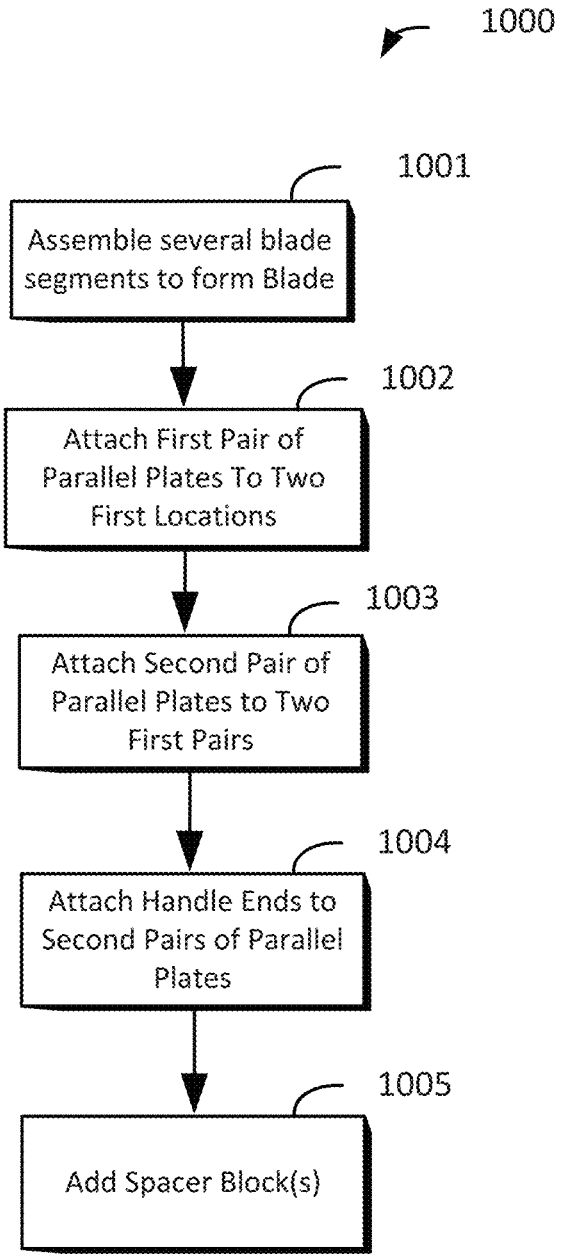
FIG. 15 is a schematic illustration of a method for assembly of the shovel assembly according to an embodiment of the present disclosure.

FIG. 15 shows a method of assembly of a shovel assembly 1000, comprising the steps of using 1001 a first connector to attach via the connecting means on the side of the first multi-blade segment to a second multi-blade segment forming a blade assembly, using a second connector to attach a first pair 1002 of the first parallel plates to the first location on one of the two segments of the blade assembly, using a third connector to attach a second pair of the first parallel plates to the first location of the other of the two segments of the blade assembly, attaching to each of the two pairs 1003 of first parallel plates the two pairs of second parallel plates using a first pivoting connector, attaching 1004 to each of the two pairs of second parallel plates respectively the two ends of the handle using a second pivoting connector, and attaching 1005 using a fourth connector the base of at least one spacer block to either the right mounting space or the left mounting space adjacent to the first location and wherein the method further includes the step of attaching using a fifth connector the base of at least a second spacer block to either the right mounting space or the left mounting space adjacent to a different first location.

In yet another method, what is contemplated is a new method of use of the shovel assembly 100 in which a user selects a first tilt angle for the blade 250, and pushes the shovel forward on one edge of a surface to clear. The user then drags back the shovel 100 and before the user can clear a different length of the surface, using the handle area 300, the user simply moves the dynamic connector from one position to the next thus tilting the blade 250 to a second configuration.

Since certain changes may be made without departing from the scope of the present implementation, it is intended that all matter contained in the above description or shown in the accompanying drawings be interpreted as illustrative and not in a literal sense. Practitioners of the art will realize that the sequence of steps and architectures depicted in the figures may be altered without departing from the scope of the present implementation and that the illustrations contained herein are singular examples of a multitude of possible depictions of the present implementation.

What is claimed is:

1. A method of assembly of a shovel assembly, the shovel assembly comprising at least two blade segments each having two sides each with a connecting means for connecting to one another to form a multi-blade segment, a back surface in opposition to a flat front surface with a first location and on each side adjacent to the first location a right mounting space or a left mounting space for a spacer block with a base, a modular handle having at least two ends each pivotally connected through a dynamic connector to the first location, at least a pair of spacer blocks, at least a pair of first parallel plates, and at least a pair of second parallel plates, the method comprising the steps of: using a first connector to attach, via the connecting means on the side of the first blade segment to the second blade segment forming a blade assembly;

using a second connector to attach the first set of the first parallel plates to the first location on one of the two segments of the blade assembly;

using a third connector to attach the second pair of first parallel plates to the first location of the other of the two segments of the blade assembly;

attaching to each of the two pairs of first parallel plates the two pairs of second parallel plates using a first pivoting connector;

attaching to each of the two pairs of second parallel plates respectively the two ends of the handle using a second pivoting connector; and attaching using a fourth connector the base of at least one spacer block to either the right mounting space or the left mounting space adjacent to the first location.

2. The method of claim 1, wherein the method further includes the step of attaching a fifth connector the base of at least a second spacer block to either the right mounting space or the left mounting space adjacent to a different first location.

* * * * *